US006348012B1

(12) United States Patent
Erickson et al.

(10) Patent No.: US 6,348,012 B1
(45) Date of Patent: Feb. 19, 2002

(54) GOLF CLUB AND WEIGHTING SYSTEM

(75) Inventors: Joel B. Erickson, Carlsbad; John G. Guard, Oceanside; James F. Dooley, Fallbrook; M. Grace Hohn Pimentel, Oceanside; Thomas J. DiMarco, Carlsbad, all of CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 09/672,269

(22) Filed: Sep. 28, 2000

Related U.S. Application Data

(62) Division of application No. 09/330,292, filed on Jun. 11, 1999.

(51) Int. Cl.[7] ..... A63B 53/04; A63B 53/06; B23K 20/10; B23P 19/00

(52) U.S. Cl. ..... 473/324; 473/349; 473/409; 29/821; 228/110.1

(58) Field of Search ..... 473/349, 350, 473/342, 345, 346, 409; 29/821; 228/110.1; 164/39

(56) References Cited

U.S. PATENT DOCUMENTS

| | | | | |
|---|---|---|---|---|
| 4,502,687 A | * | 3/1985 | Kochevar | 273/171 |
| 4,600,046 A | * | 7/1986 | Bailey et al. | 164/34 |
| 5,429,292 A | * | 7/1995 | Melton et al. | 228/180.22 |
| 5,499,819 A | * | 3/1996 | Nagamoto | 273/169 |

* cited by examiner

*Primary Examiner*—Paul T. Sewell
*Assistant Examiner*—Sneh Varma
(74) *Attorney, Agent, or Firm*—Michael A. Catania

(57) ABSTRACT

A golf club head having a defined internal cavity, and a golf club head containing a bi-material weight having a nonhomogeneous structure is disclosed herein. A method to add the bi-material weight to the golf club entails heating, vibration and cooling to produce the nonhomogeneous structure is also disclosed herein.

16 Claims, 9 Drawing Sheets

#5 IRON

| | |
|---|---|
| FINISHED HEAD WEIGHT = | 252 |
| FULL CAVITY VOLUME = | 11.5 |

| VOLUME % RATIO OF SPHERE TO SOLDER | TUNGSTEN SPHERE (g/cc) | % OF CAVITY VOLUME | SOLDER DENSITY (g/cc) | % OF CAVITY VOLUME | VOLUME USED IN CAVITY (-.5cc FROM FULL) | SLUG WEIGHT (GRAMS) | TUNGSTEN SPHERE (GRAMS) | SOLDER (GRAMS) | SLUG WEIGHT (g/cc) | FINISHED HEAD WEIGHT | UNFILLED HEAD WEIGHT NEEDS TO BE: |
|---|---|---|---|---|---|---|---|---|---|---|---|
| 0.0% TO 100.0% | 18.20 | 0.000 | 8.58 | 1.000 | 11.00 | *94.38* | .00 | 94.38 | 8.58 | 252 | 157.62 |
| 10.0% TO 90.0% | 18.20 | 0.100 | 8.58 | 0.900 | 11.00 | *104.96* | 20.02 | 84.94 | 9.54 | 252 | 147.04 |
| 12.5% TO 87.5% | 18.20 | 0.125 | 8.58 | 0.875 | 11.00 | *107.61* | 25.03 | 82.58 | 9.78 | 252 | 144.39 |
| 15.0% TO 85.0% | 18.20 | 0.150 | 8.58 | 0.850 | 11.00 | *110.25* | 30.03 | 80.22 | 10.02 | 252 | 141.75 |
| 17.5% TO 82.5% | 18.20 | 0.175 | 8.58 | 0.825 | 11.00 | *112.90* | 35.04 | 77.86 | 10.26 | 252 | 139.10 |
| 20.0% TO 80.0% | 18.20 | 0.200 | 8.58 | 0.800 | 11.00 | *115.54* | 40.04 | 75.50 | 10.50 | 252 | *136.46* |
| 22.5% TO 77.5% | 18.20 | 0.225 | 8.58 | 0.775 | 11.00 | *118.19* | 45.05 | 73.14 | 10.74 | 252 | 133.81 |
| 25.0% TO 75.0% | 18.20 | 0.250 | 8.58 | 0.750 | 11.00 | *120.84* | 50.05 | 70.79 | 10.99 | 252 | 131.17 |
| 27.5% TO 72.5% | 18.20 | 0.275 | 8.58 | 0.725 | 11.00 | *123.48* | 55.06 | 68.43 | 11.23 | 252 | 128.52 |
| 30.0% TO 70.0% | 18.20 | 0.300 | 8.58 | 0.700 | 11.00 | *126.13* | 60.06 | 66.07 | 11.47 | 252 | 128.87 |
| 32.5% TO 67.5% | 18.20 | 0.325 | 8.58 | 0.675 | 11.00 | *128.77* | 65.07 | 63.71 | 11.71 | 252 | 123.23 |
| 35.0% TO 65.0% | 18.20 | 0.350 | 8.58 | 0.650 | 11.00 | *131.42* | 70.07 | 61.35 | 11.95 | 252 | 120.58 |

| MAXIMUM FILL RATIO | | | | | | | | | | MAX. HEAD WEIGHT | AVERAGE UNFILLED HEAD WEIGHT |
|---|---|---|---|---|---|---|---|---|---|---|---|
| 40.0% TO 60.0% | 18.20 | 0.400 | 8.58 | 0.600 | 11.00 | *136.71* | 80.08 | 56.63 | 12.43 | 272.68 | 135.97 |

DELTA OF MAX. HEAD WEIGHT AND FINISHED HEAD WEIGHT = 20.68

*FIG. 17*

GOLF CLUB AND WEIGHTING SYSTEM

CROSS REFERENCES TO RELATED APPLICATIONS

This patent application is a divisional application of co-pending U.S. patent application Ser. No. 09/330,292, filed on Jun. 11, 1999.

STATEMENT REGARDING FEDERALLY SPONSORED RESEARCH OR DEVELOPMENT

Not applicable

BACKGROUND OF THE INVENTION

1. Field of the Invention

The present invention relates to golf clubs and, more specifically, a golf club head and weighting method to provide better performance, greater weighting flexibility and lower production costs.

2. Description of the Related Art

The location and distribution of weight within a golf club is an important factor in the performance of the golf club. In particular, weight placement at the bottom of the golf club head provides a low center of gravity to help propel a golf ball into the air during impact, and weight concentrated at the toe and heel of the golf club head provides a resistance to twisting, or high moment of inertia, during golf ball impact. Both the low center of gravity and high moment of inertia are important performance variables which affect playability and feel of the golf club. Alternative designs have resulted in many innovations for varying the weight location and distribution in a golf club head portion. Among these designs is a combination of high and low density materials within the golf club head, and associated methods for combining these materials.

One example of multiple materials used in the construction of the golf club head is a high density material attached to a lower density material golf club head. A high density block or contoured shape is attached, via mechanical means such as friction fit, fasteners or screws, to a reciprocal recess in the golf club head, as shown in U.S. Pat. No. 5,776,010, issued to Helmstetter et al. Although supplying the desired performance enhancements, the high density block and the reciprocal recess must be machined to precise tolerances, involving high production costs.

Another example of weighting the golf club is pouring a high density fluid into a reservoir within the golf club. This ensures an exact placement of the weighting material within the golf club, as the fluid will conform to the internal shape of the reservoir without the need for mechanical or an adhesive bonding. One drawback of this type of processing is the requirement that one must operate below the melt or softening temperature of the club head material. In addition, as processing temperatures increase the associated costs will increase to accommodate higher energy use and high temperature equipment. The limitations for a low melt temperature, yet high density, material restricts the available options for this type of process.

To overcome the limitations associated with a single material, the advent of multi-component weighting systems makes use of the high density materials in combination with a carrier fluid, such as a polymer. A particulate form of the high density material is mixed with the carrier fluid and poured into the reservoir in the golf club, wherein the carrier fluid is allowed to solidify to form a composite weighting material. Readily available materials include a thermoset polymer carrier fluid, such as epoxy, which allows ambient temperature processing and solidification of the high density material and epoxy mixture. A thermoplastic polymer carrier fluid, such as polypropylene, requires heat to obtain a fluid state and cools to a solid at ambient temperatures, with the capability to be re-heated to the fluid state, in distinction to the epoxy. A disadvantage of the multi-component weighting system is the low density associated with the carrier fluid, typically 1 g/cm$^3$, thus requiring a high ratio of the weighting material to the carrier fluid to obtain the desired high density for a bi-material weight. The carrier fluid also acts as a binder for the weighting material to ensure the bi-material weight forms a solid block.

A drawback to the multi-component weighting system is the need to use small amounts of carrier fluid relative to the weighting material, leading to entrapped air or voids and incomplete binding in the bi-material weight. Incorporating larger amounts of the carrier fluid promotes better mixing within the bi-material weight in conjunction with an attendant decrease in density. Therefore, it is desirable to provide a bi-material weight containing a higher density carrier fluid to provide greater weighting flexibility for allocating weight within a golf club head in conjunction with lower cost production. It is further desirable to provide a golf club head to accommodate the bi-material weight and enable a variable location of the bi-material weight.

SUMMARY OF THE INVENTION

The present invention addresses the problems of the golf industry by providing a bi-material weight and a golf club head that when used in combination result in a golf club that provides a low center of gravity, and superior feel and playability. A distinctive feature of the bi-material weight of the present invention is the use of vibrational energy to provide complete contact between the high density material and the lower density material. This embodiment reduces or eliminates voids associated with mixing dissimilar density materials, and promotes migration, or orientation, of the high and lower density materials to the preferred location within the golf club head.

In a preferred embodiment, the bi-material weight is a nonhomogeneous mixture composed of a high density metal material forming a discontinuous phase, and a lower density metal material forming a continuous phase. The choice of metal materials is advantageous for their high density, metal to metal compatability, availability and for many alloys good long term environmental stability. Among the choices for the high density metal material are copper metals, brass metals, steel and tungsten metals; wherein the lower density metals afford a low melt temperature and include several types of solder. In a most preferred embodiment, a plurality of tungsten spheres comprises the high density metal forming the discontinuous phase, and a bismuth-tin solder comprises the lower density metal forming the continuous phase. An important operation in achieving the nonhomogeneous mixture is providing the lower density material in a liquid state, followed by imparting vibrational energy to diminish or eliminate voids and permit migration of the high density metal material to a preferred location within the golf club head, followed by solidification of the lower density material.

A preferred embodiment of the present invention is generally descriptive of a class of golf clubs known as irons. Within this class is a type of iron referred to as a cavity back iron, and well known to those of ordinary skill in the art, which contains a continuous ribbon, or flange, of material at the outer periphery of the rear face of the iron. This construction yields an open cavity, or first cavity, in the rear or back of the iron and yields a larger "sweet spot" in the front or striking face of the iron to provide a wider margin of error in striking the golf ball. The ribbon of material located below the open cavity, extending between the heel and toe and adjacent the bottom periphery of the golf club head, contains an internal cavity, also referred to herein as a second cavity or weight pocket, for accepting a weighting material. This cavity contains at least one inlet into an interior volume, or interior space, of the internal cavity, having a vertical dimension between a ceiling wall, or top wall, and a bottom wall, and a horizontal dimension between a toe region and a heel region of the golf club head. In a preferred embodiment, the internal shape, or configuration, of the internal cavity allows weight to be located in the toe region or heel region to help a golfer open or close the golf club head relative to the intended target line. Specifically, weight located in the toe region helps to open the golf club head, and weight located in the heel region helps to close the golf club head. In addition, an expanded center volume portion of the internal cavity allows for a vertical density transition zone in the bi-material weight, resulting in a more satisfying feel during golf ball impact.

In a preferred embodiment, an undercut recess is located rearward of a front face of the golf club, as discussed in U.S. Pat. No. 5,282,625, issued to Schmidt et al., which is hereby incorporated by reference. The purpose of the undercut recess is to help expand the "sweet spot", in conjunction with "sweet spot" improvement inherent in the cavity back iron, by moving weight to a rearward peripheral region of the golf club head. In addition, the rearward location of the bi-material weight improves playability by helping propel the golf ball into the air during impact with the golf club.

Accordingly, it is an object of the present invention to provide a bi-material weighting system for golf clubs to allow a greater flexibility in locating the center of gravity and providing better feel.

It is another object of the present invention to impart vibrational energy to a bi-material weighting system for golf clubs to allow better mixing and orientation between the weighting materials to form a continuous phase and a discontinuous phase.

A further object of the present invention is to provide a golf club head containing an internal cavity having an expanded vertical dimension in the center of the cavity, thereby allowing greater precision in locating high density material in the center of the golf club head.

Another object of the present invention is to provide a cavity-back titanium alloy iron golf club head with a cavity containing a plurality of tungsten alloy spheres and a bismuth-tin solder.

BRIEF DESCRIPTION OF THE DRAWINGS

FIG. 17 is a table to obtain a specific weight for various empty weights for the golf club head for an embodiment of the present invention.

DETAILED DESCRIPTION OF THE INVENTION

Figure 1:
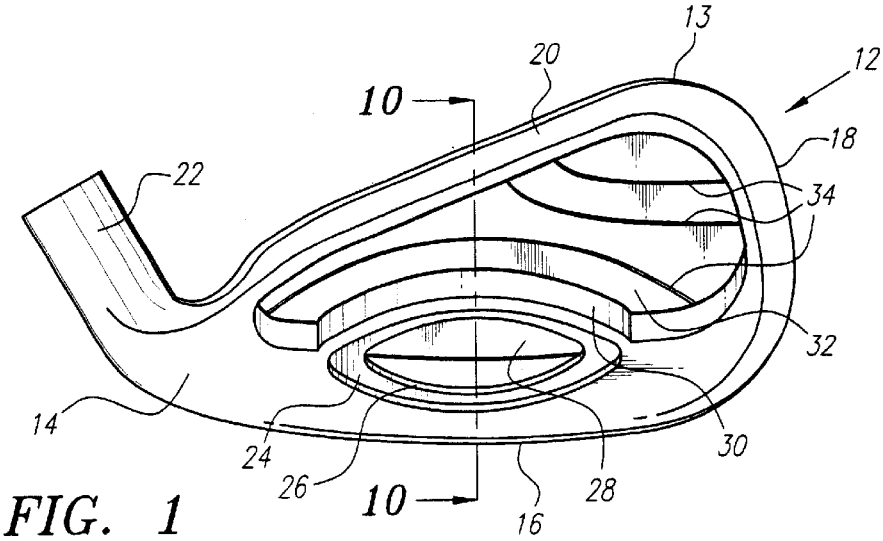
FIG. 1 is a rear view of a golf club head of an embodiment of the present invention showing an internal cavity arrangement with a contoured rear face.
Figure 2:
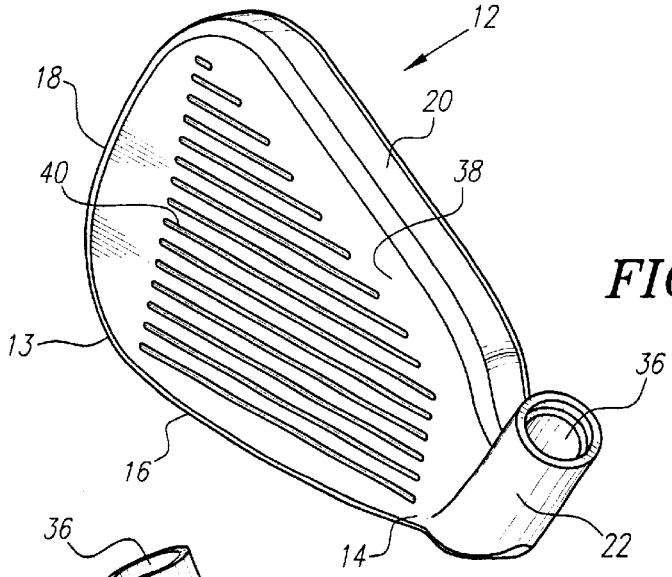
FIG. 2 is a front perspective view of the golf club head of an embodiment of the present invention.
Figure 3:
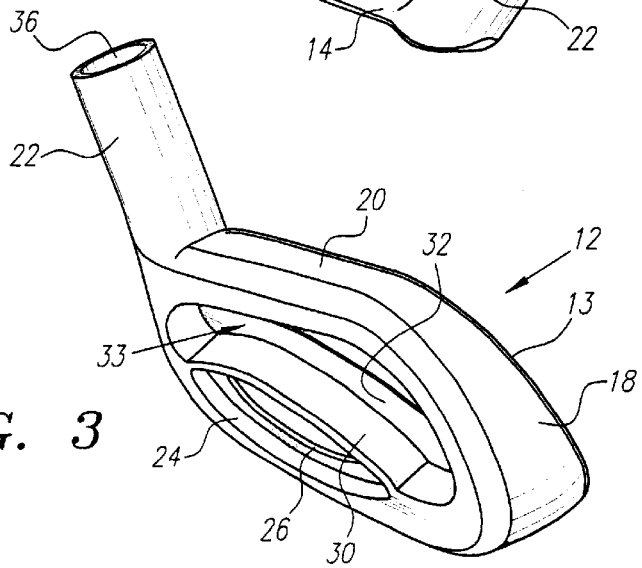
FIG. 3 is a rear perspective view of the golf club head of an embodiment of the present invention.
Figure 4:
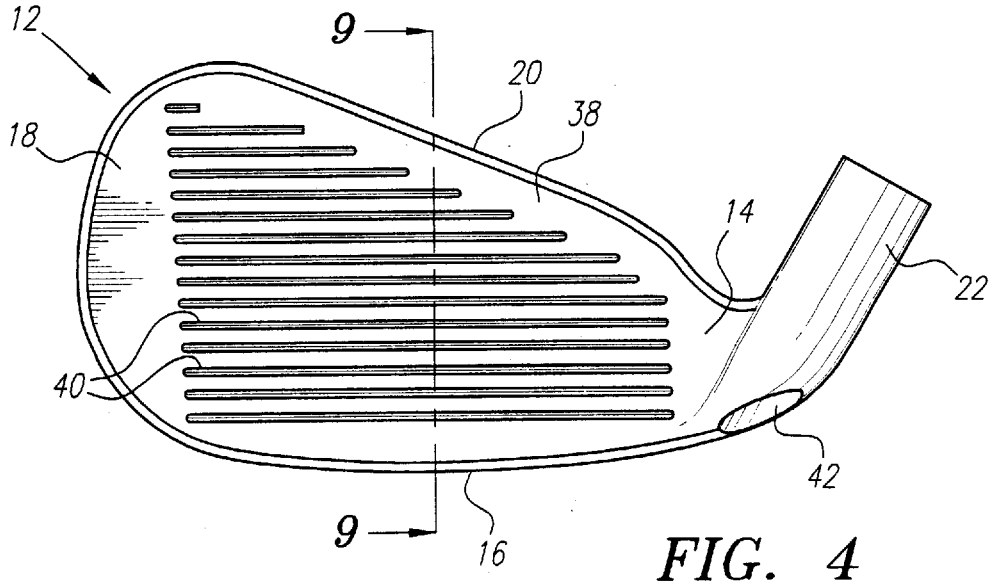
FIG. 4 is a front view of the golf club head of an embodiment of the present invention.
Figure 5:
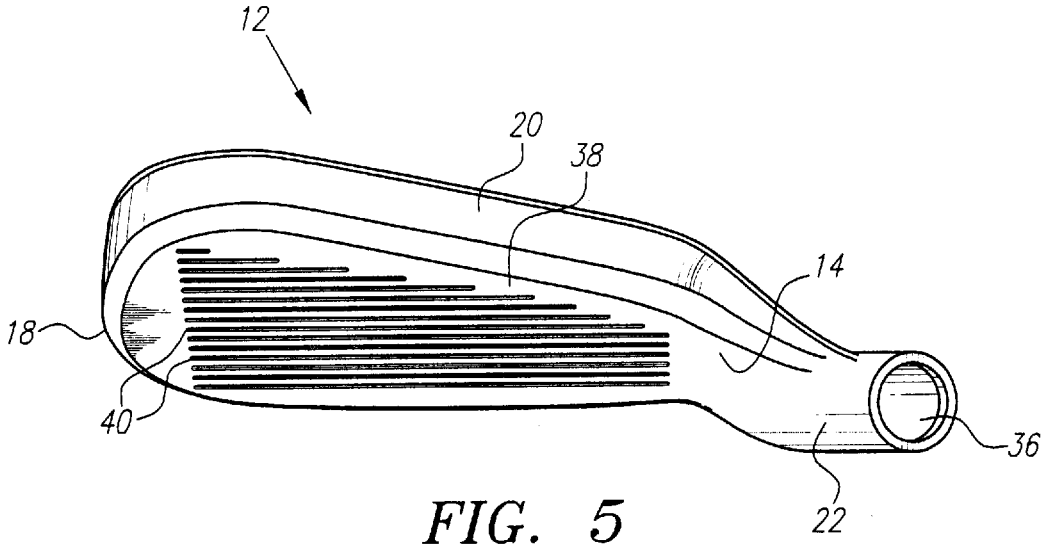
FIG. 5 is a top view of the golf club head of an embodiment of the present invention.
Figure 6:
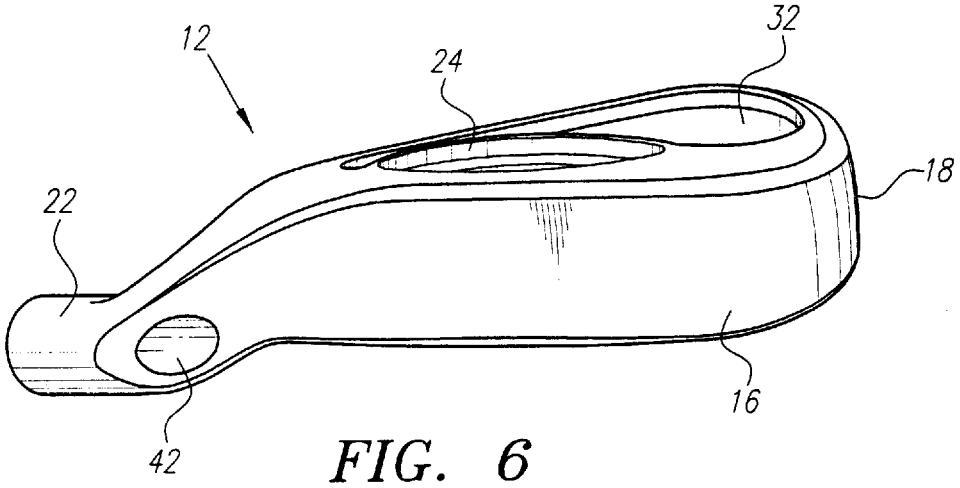
FIG. 6 is a bottom view of the golf club head of an embodiment of the present invention.
Figure 7:
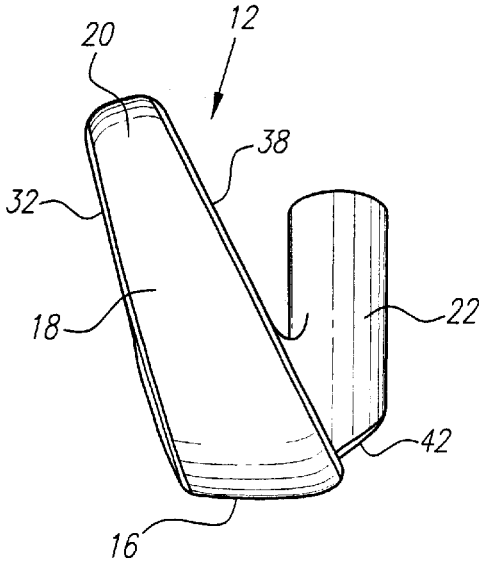
FIG. 7 is a toe view of the golf club head of an embodiment of the present invention.
Figure 8:
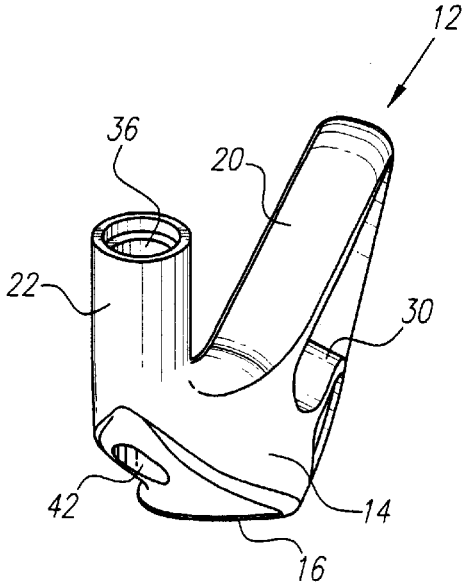
FIG. 8 is a heel view of the golf club head of an embodiment of the present invention.

As shown in FIGS. 1–8 a golf club of the present invention is generally designated 12. The golf club head 12 comprises a heel section 14, a bottom section 16, a toe section 18, a top section 20 and a hosel 22. The heel, toe, bottom and top sections, 14, 18, 16 and 20 respectively, are meant to describe general sections of the golf club head 12 and may overlap one another. The golf club 12 further comprises an inset wall 24, an entry 26, an internal cavity 28, a cavity flange 30, a rear face 32 and a series of contour lines 34 extending generally from the heel section 14 to the toe section 18. The internal cavity 28 is located within the rear flange 30, and generally extends adjacent the bottom section 16 from the heel section 14 to the toe section 18. In a preferred embodiment, a heel wall 44 (shown in phantom in FIG. 1) and a toe wall 52 (shown in phantom in FIG. 1) defines the lateral extent of the internal cavity 28. The internal cavity 28 has a volume from 5 $cm^3$ to 25 $cm^3$, and in a most preferred embodiment from 9 $cm^3$ to 15 $cm^3$. The length and volume of the internal cavity allow for flexibility in the placement of the bi-material weight of the present invention to control the location of the center of gravity in order to improve the feel during impact of the golf club head with the golf ball.

The golf club head 12 further comprises a hosel inlet and a hosel exit, 36 and 40 respectively, for accepting the distal end of a golf shaft (not shown), a face 38 for impacting the golf ball (not shown) and a set of scorelines 40.

Figure 9:
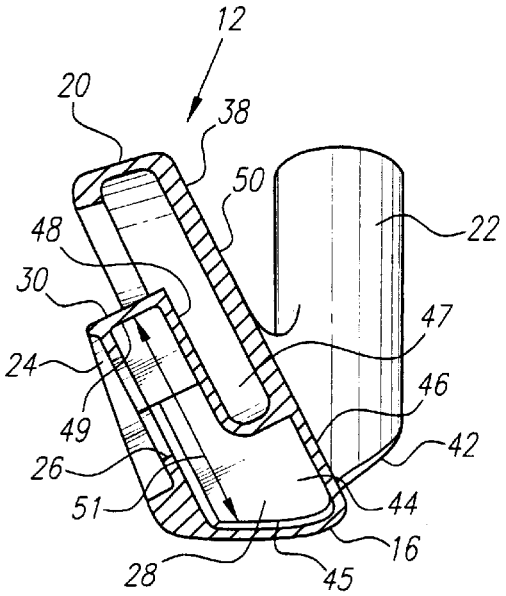
FIG. 9 is a cut-away view along line 9—9, as shown in FIG. 4, of the golf club head of an embodiment of the present invention.
Figure 10:
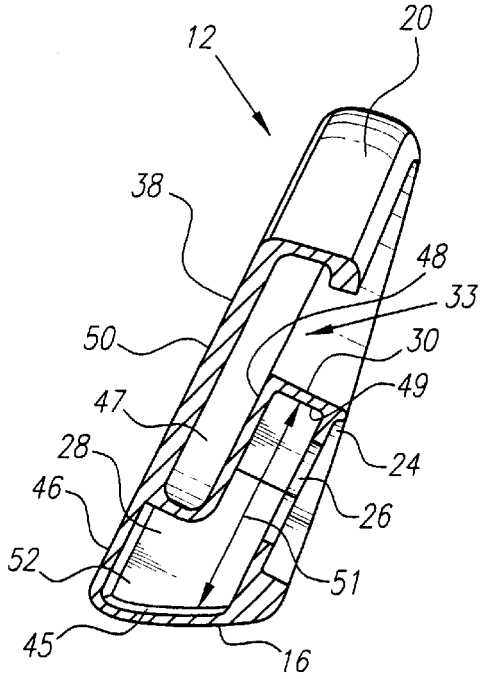
FIG. 10 is a cut-away view along line 10—10, as shown in FIG. 1, of the golf club head of an embodiment of the present invention.
Figure 11:
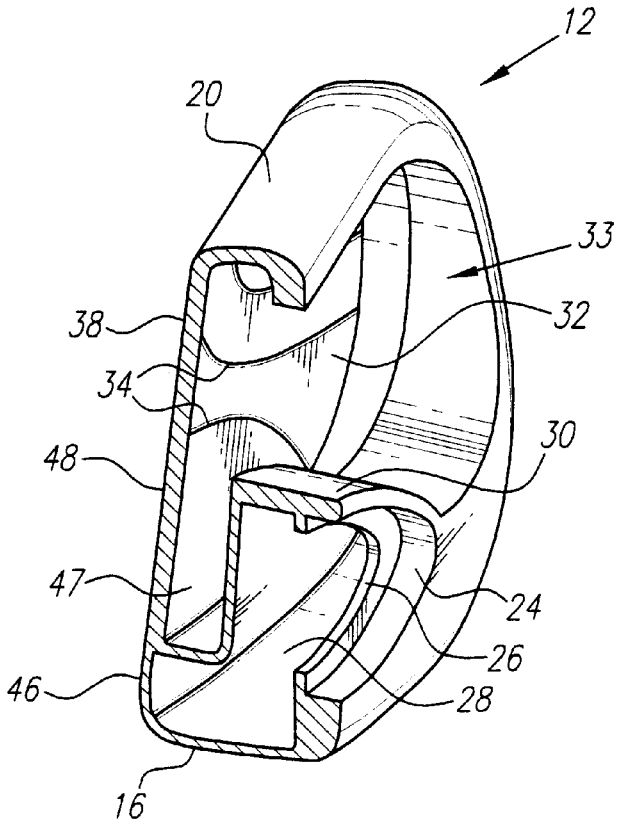
FIG. 11 is a rear perspective view of FIG. 10 of the golf club head of an embodiment of the present invention.

As shown in FIGS. 9–11 the golf club of the present invention is generally designated 12. The golf club 12 further comprises the heel wall 44, a floor wall 45, a lower face thickness 46, an undercut recess 47, a front wall 48, a ceiling wall 49 and an upper face thickness 50. In a preferred embodiment the boundaries of the internal cavity 28 are defined by the lower face thickness 46, the upper face 48, the ceiling wall 49, the floor wall 45, the inset wall 24, the heel wall 44 and the toe wall 52 (as shown in FIG. 10). The distance between the floor wall 45 and the ceiling wall 49 is defined by a gap 51 having a first minimum at the heel wall 44 and a second minimum at the toe wall 52 (as shown in FIG. 10). The volume of the internal cavity 28 near the heel and the toe wall, 44 and 52 respectively, can be reduced because the effectiveness of weight placed at these locations is higher than that an equal weight placed in the center of the internal cavity 28. In a preferred embodiment the gap 51 reaches a maximum between the heel wall 44 and the toe wall 52 (as shown FIG. 10) to produce a vertical density transition zone producing better feel during golf ball impact. The lower face thickness 46 is less than upper face thickness 50 to lighten the golf club head 12, allowing more weight to be moved to the internal cavity 28 yet ensuring adequate structural strength for the lower face thickness 46. In a preferred embodiment, the entry 26 for the internal cavity 28 is located on the inset wall 24 and is covered by a medallion (not shown). In a preferred embodiment the golf club head 12 is made of a titanium alloy.

Figure 12:
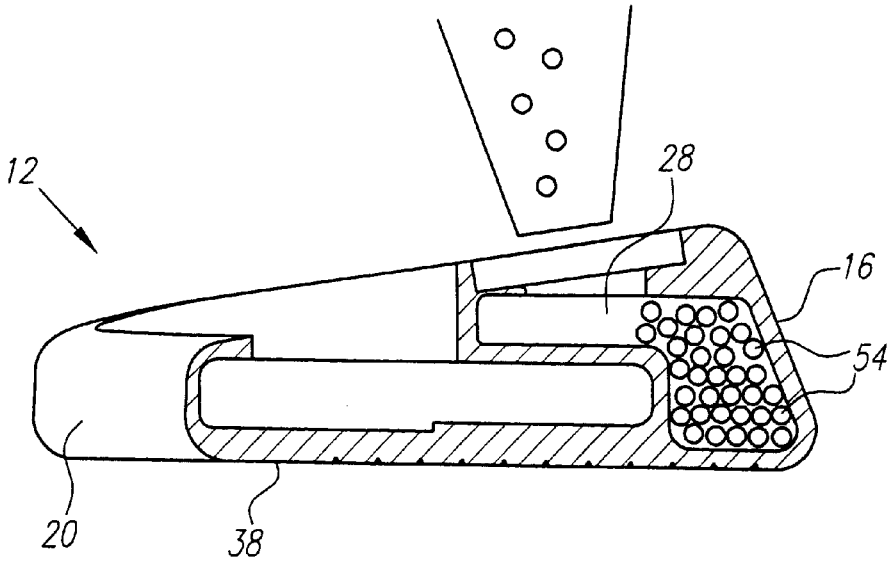
FIG. 12 is a cut-away view of the golf club head and the first weight material of an embodiment of the present invention.
Figure 14:
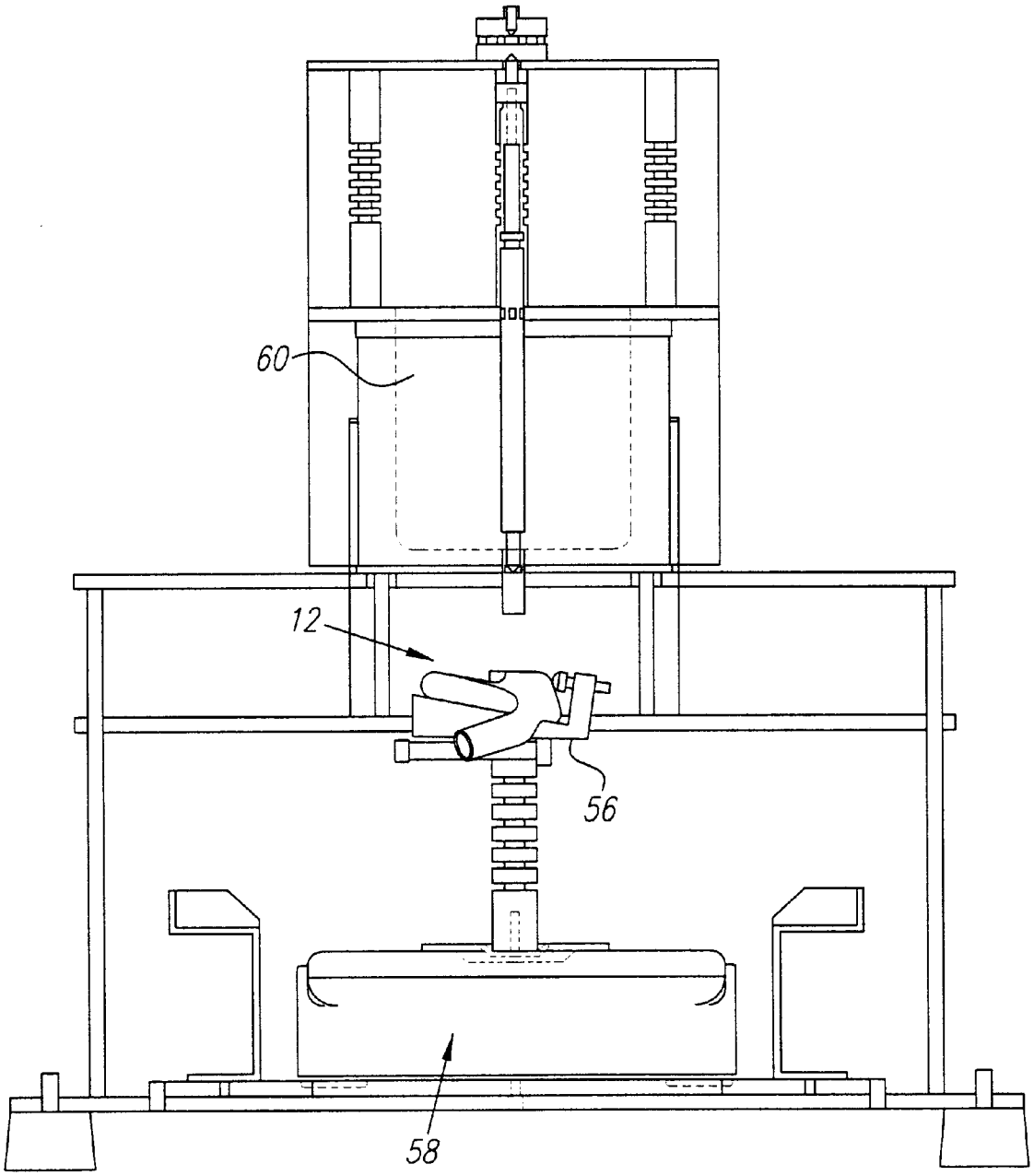
FIG. 14 is a heel view of the golf club head during addition of the second weight material of an embodiment of the present invention.

A preferred method for adding weight material to the golf club head 12 involves a bi-material weighting operation. FIG. 12 is a cut-away view of the golf club head 12 of a method embodiment of the present invention. The golf club head 12 is weighed and a predetermined, or specific, weight of a first weight material 54 is added to the internal cavity 28. In a preferred embodiment the first weight material 54 occupies 10% to 40% of the internal cavity 28. In a more preferred embodiment a metal material forms the first weight material 54 and exhibits a high density, good compatibility with structural metals such as titanium and steel, high environmental stability and good commercial availability. Available choices for the first weight material 54 are copper metals, brass metals, steel and tungsten metals. In a preferred embodiment the density of the first weight material 54 is greater than 12 g/cm$^3$, more preferred is between 12 g/cm$^3$ and 20 g/cm$^3$. In a most preferred embodiment, the first weight material 54 comprises tungsten alloy spheres, with approximately 18 g/cm$^3$ density and having a diameter greater than 3 mm, dispensed into the internal cavity 28 of the golf club head 12. The requirement for a diameter in excess of 3 mm is to provide an effective fluid path between the spheres and ensure a fully dense weight block. The golf club head 12 and the first weight material 54 are raised to a temperature sufficient to maintain a second weight material 60 (as shown in FIG. 14) in a fluid or liquid phase. In a preferred embodiment, a continuous oven is used to raise the temperature of the golf club head 12 and the first weight material 54 to at least 350° F. Although several heating methods are available, in a preferred operation the golf club head 12 containing the tungsten alloy spheres is placed upon a heated conveyor moving at 5.5 inches/minute through a 24 inch heat zone.

Figure 13:
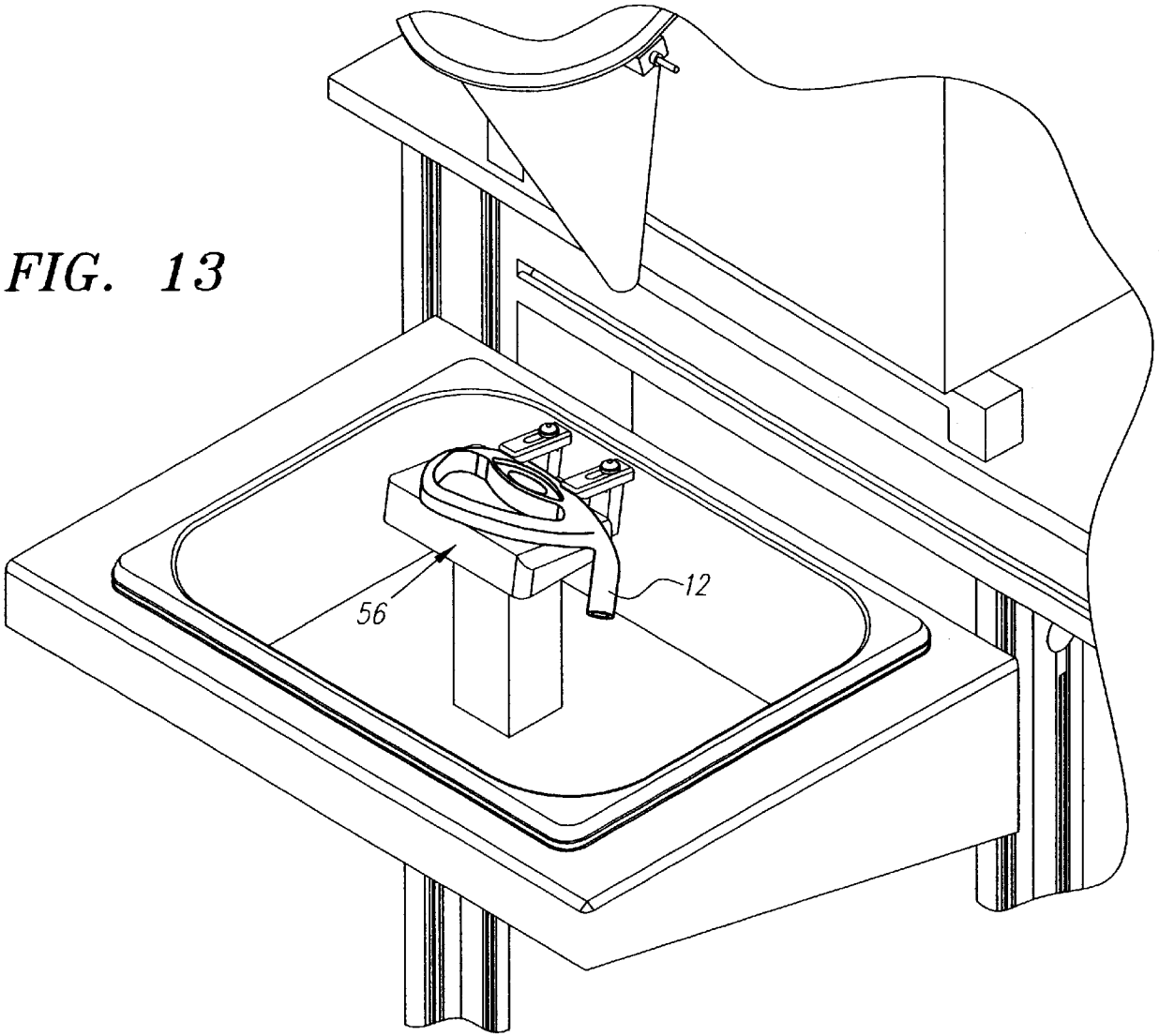
FIG. 13 is a top perspective view of the golf club head within a fixture of an embodiment of the present invention.

After exiting the heating operation the golf club head 12 containing the tungsten alloy spheres is secured in a fixture 56, as shown in FIG. 13. The second weight material 60 is then poured into the cavity 28 in the golf club head 12, as shown in FIG. 14. In a preferred embodiment the density of the second weight material 60 is less than 14 g/cm$^3$, more preferred is between 6 g/cm$^3$ and 10 g/cm$^3$. In a most preferred embodiment, the second weight material 60 is a bismuth-tin solder, with approximately 8.6 g/cm$^3$ density, heated to a liquid phase of at least 350° F. The weighting method may include any number of combinations associated with heating the golf club head 12 and the first and second weight materials 56 and 60 to form a finished product. Attached to the fixture 56 is a scale 58 to measure the total weight of the golf club head 12 during addition of the second weight material 60. In a preferred embodiment, the scale 58 is used throughout the weighting method to ensure that the proper amount of the first and the second weight material 54 and 60 have been added to the golf club head 12.

Figure 15:
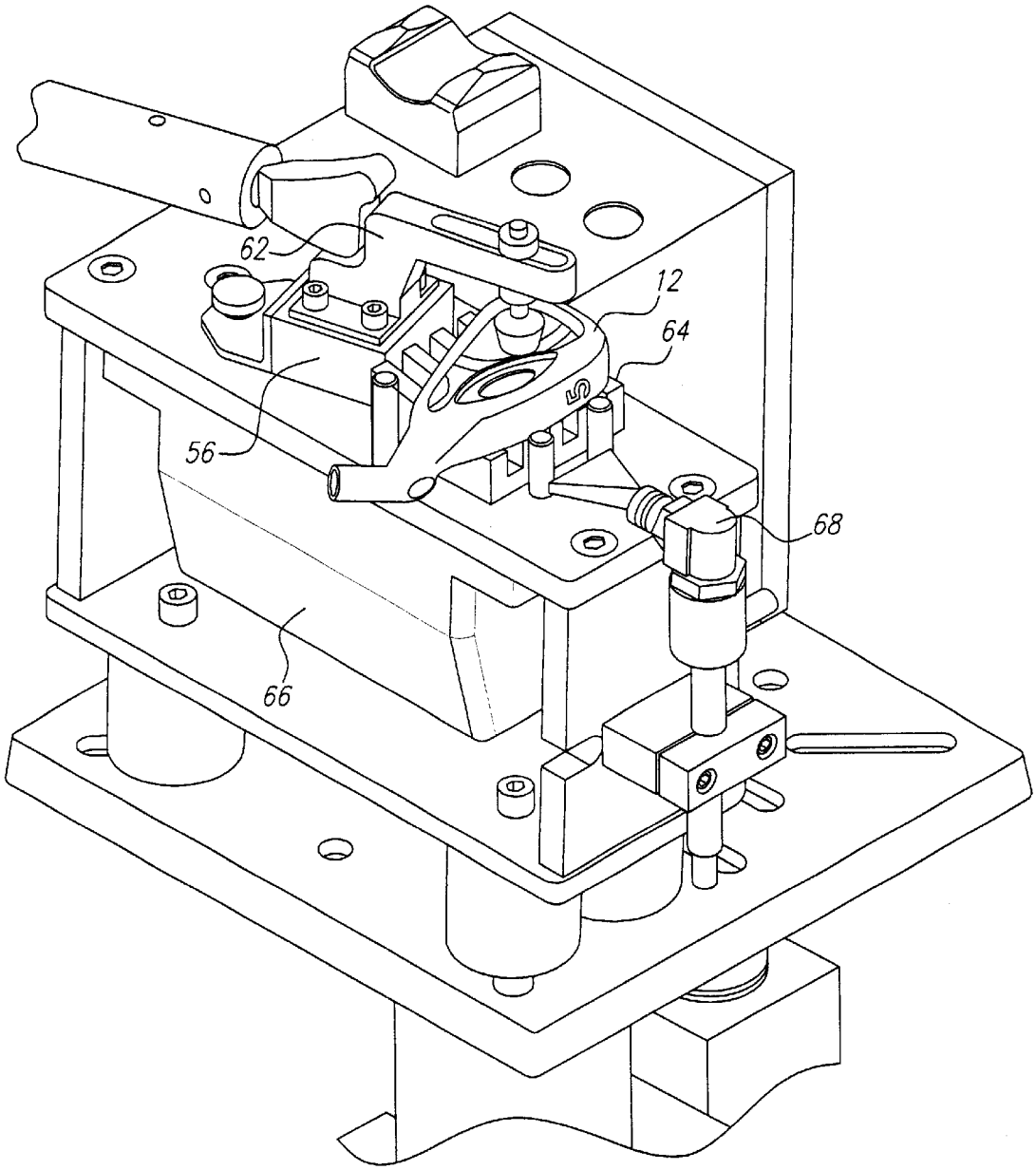
FIG. 15 is a top perspective view for clamping the golf club head of an embodiment of the present invention.
Figure 16:
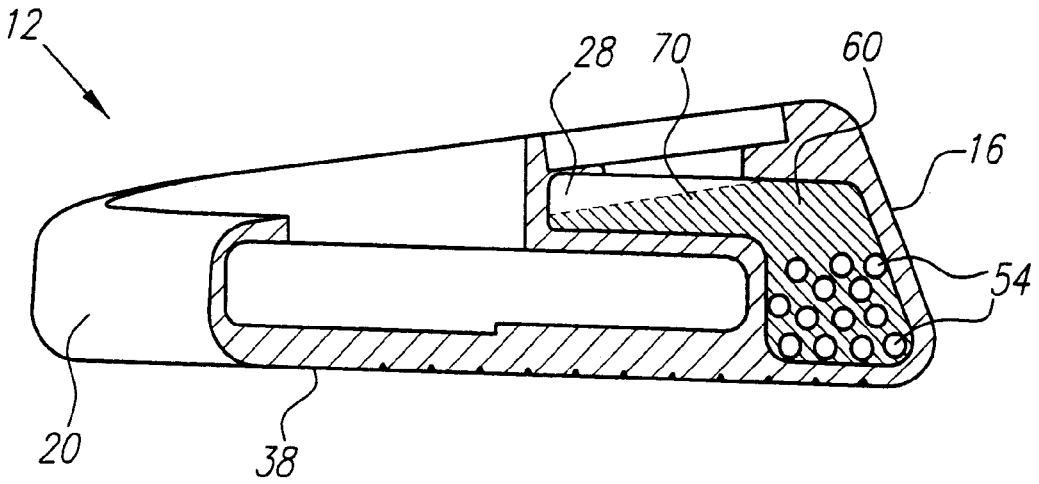
FIG. 16 is a cut-away view of the golf club head containing the bi-material weight of an embodiment of the present invention.

The golf club head 12 is forced against the fixture 56 and a mounting pad 64 via a clamp 62, as shown in FIG. 15. The mounting pad 64 is used to tilt the golf club head 12 to any desired orientation allowing the first weight material to migrate to the lowest point in the internal cavity 28 under the influence of vibrational energy. Vibrational energy treatment of the golf club 12 and a bi-material weight 70 (as shown in FIG. 16) may be accomplished by a mechanical device, ultrasound, radiation, or any other means of imparting vibrational energy. In a preferred embodiment, a mechanical vibration device supplies a small amplitude vibration to the golf club head 12. The timing for starting and stopping the vibration is an important factor in obtaining the benefits of the present invention. The second weight material 60 should be in a liquid phase while exposed to vibration energy to prevent the first weight material 54 from creating voids or migrating out of the second weight material 60. In a preferred embodiment, the vibrational energy is sustained for approximately 20 seconds. Following termination of the vibrational treatment, the golf club head 12 is cooled to allow the second weight material 60 to solidify. Cooling of the bi-material weight 70 may be accomplished by refrigeration, immersion in a cold fluid such as water, or simply allowing the golf club head 12 to cool naturally to ambient temperature. In a preferred embodiment, an air nozzle 68 supplies cooling air to the golf club head 12.

FIG. 16 shows the golf club head 12 containing the bi-material weight 70 comprising the first weight material 54 and the second weight material 60. The golf club head 12 may have a range of initial weights reflecting variability in manufacturing the golf club head 12. To accommodate this variability the specific weight for the golf club head 12 is illustrated in FIG. 17, which lists the ratio of the first and second weight material 56 and 60 used in a 5 iron of the present invention.

Figure 18:
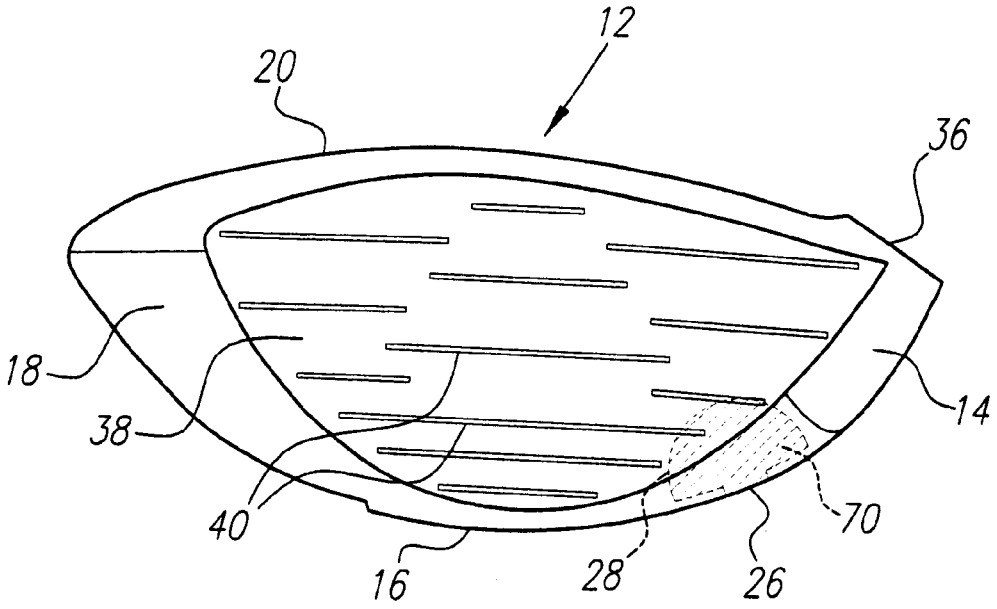
FIG. 18 is a front view of an alternative embodiment of the golf club of the present invention showing a wood club head.

An alternative embodiment of the present invention is a wood configuration for the golf club head 12, as illustrated in FIG. 18, containing the internal cavity 28 and the bi-material weight 70. The location of the internal cavity 28 is not limited to that illustrated in FIG. 18, but can be placed in various locations within the golf club head 12 to adjust center of gravity affecting feel and playability.

It is understood that various modifications can be made to the golf club head 12 and method of weighting, both outlined above, and remain within the scope of the present invention. For example, the golf club head 12 can be a wood-type golf club, a putter or an iron-type golf club, and can be made from various materials including metals and non-metals.

While preferred embodiments have been discussed and illustrated above, the present invention is not limited to these descriptions or illustrations, and includes all such modifications which fall within the scope of the invention and claim language presented below.

We claim:

1. A method of producing a golf club head with a specific weight, the golf club head having an internal cavity defined by a plurality of walls of the golf club head, the internal cavity having an opening for access thereto, the method comprising:

placing a plurality of tungsten spheres within the internal cavity;

dispensing a second weight material into the internal cavity, the second weight material heated to a liquid phase, the second weight material having a density that is lower than tungsten;

imparting vibrational energy to orient the plurality of tungsten spheres throughout the second weight material within the internal cavity; and cooling the second weight material to a solid phase within the internal cavity.

2. The method according to claim 1 further comprising heating the golf club head and the plurality of tungsten spheres within the internal cavity prior to dispensing the second weight material.

3. The method according to claim 1 wherein the internal cavity defines a cavity volume, and the plurality of tungsten spheres occupies 10% to 40% of the cavity volume.

4. The method according to claim 1 wherein the weight of the plurality of tungsten spheres is 15% to 60% of the weight of a combination of the plurality of tungsten spheres and the second weight material.

5. The method according to claim 1 wherein the plurality of tungsten spheres is oriented toward a toe region of the golf club head.

6. The method according to claim 1 wherein the plurality of tungsten spheres is oriented toward a heel region of the golf club head.

7. The method according to claim 1 wherein the plurality of tungsten spheres is oriented for equal distribution throughout the cavity.

8. The method according to claim 1 further comprising weighing the golf club head.

9. A method of producing a golf club head with a specific weight, the golf club head having an internal cavity defined by a plurality of walls of the golf club head and having an opening for access thereto, the method comprising:

placing a first weight material into the internal cavity through the opening, the first weight material having a density ranging from 12 g/cm$^3$ to 20 g/cm$^3$;

dispensing a second weight material into the internal cavity through the opening, the second weight material heated to a liquid phase, the second weight material having a density that is less than the density of the first weight material;

imparting vibrational energy to the golf club head to provide intimate contact between the first weight material which forms a discontinuous phase and the second weight material which forms a continuous phase; and cooling the second weight material to a solid phase within the internal cavity.

10. The method of claim 9 further comprising heating the golf club head and the first weight material prior to dispensing the second weight material into the internal cavity.

11. The method of claim 9 wherein the internal cavity defines a cavity volume, and the first metal material occupies 10% to 40% of the cavity volume.

12. The method of claim 9 wherein the weight of the first weight material is 15% to 60% of the weight of a combination of the first and the second weight material.

13. A method of producing a golf club head with a specific weight, the golf club head having an internal cavity defined by a plurality of walls of the golf club head, the internal cavity having an opening for access thereto, the method comprising:

placing a plurality of tungsten alloy spheres within the internal cavity;

dispensing a bismuth-tin solder into the internal cavity, the bismuth-tin solder heated to a liquid phase;

imparting vibrational energy to orient the plurality of tungsten alloy spheres throughout the bismuth-tin solder within the internal cavity; and cooling the bismuth-tin solder to a solid phase within the internal cavity.

14. The method according to claim 13 wherein the golf club head is an iron-type club head with a rear cavity.

15. The method according to claim 13 wherein imparting vibrational energy is accomplished by a mechanical device, ultrasound or radiation.

16. The method according to claim 13 wherein cooling the bismuth-tin solder is accomplished by refrigeration, immersion in water or air cooling.

* * * * *